US008545169B2

(12) United States Patent
Ahmad

(10) Patent No.: US 8,545,169 B2
(45) Date of Patent: Oct. 1, 2013

(54) COOLED TURBINE BLADE FOR A GAS TURBINE AND USE OF SUCH A TURBINE BLADE

(75) Inventor: Fathi Ahmad, Kaarst (DE)

(73) Assignee: Siemens Aktiengesellschaft, Munich (DE)

( * ) Notice: Subject to any disclaimer, the term of this patent is extended or adjusted under 35 U.S.C. 154(b) by 1410 days.

(21) Appl. No.: 11/989,339

(22) PCT Filed: Jul. 19, 2006

(86) PCT No.: PCT/EP2006/064414

§ 371 (c)(1),
(2), (4) Date: Jan. 24, 2008

(87) PCT Pub. No.: WO2007/012592

PCT Pub. Date: Feb. 1, 2007

(65) Prior Publication Data

US 2009/0035128 A1 Feb. 5, 2009

(30) Foreign Application Priority Data

Jul. 27, 2005 (EP) ..... 05016328

(51) Int. Cl.
*F01D 5/18* (2006.01)

(52) U.S. Cl.
USPC ..... 415/115; 416/92; 416/97 R

(58) Field of Classification Search
USPC ..... 415/115; 416/96 R, 96 A, 97 R, 416/193 A, 232, 233
See application file for complete search history.

(56) References Cited

U.S. PATENT DOCUMENTS

| | | | | |
|---|---|---|---|---|
| 4,257,737 | A | 3/1981 | Andress et al. | |
| 5,232,343 | A * | 8/1993 | Butts | 416/97 R |
| 5,472,316 | A * | 12/1995 | Taslim et al. | 416/97 R |
| 5,857,837 | A * | 1/1999 | Zelesky et al. | 416/97 R |
| 6,227,804 | B1 * | 5/2001 | Koga et al. | 416/96 R |
| 7,377,747 | B2 * | 5/2008 | Lee | 416/97 R |
| 2004/0146402 | A1 * | 7/2004 | Soechting et al. | 416/97 R |
| 2006/0002795 | A1 * | 1/2006 | Liang | 416/97 R |

FOREIGN PATENT DOCUMENTS

| | | | |
|---|---|---|---|
| EP | 1 267 040 | A2 | 12/2002 |
| EP | 1 469 163 | A2 | 10/2004 |
| JP | 02011801 | A * | 1/1990 |
| JP | 10280904 | A | 10/1998 |

* cited by examiner

*Primary Examiner* — Edward Look
*Assistant Examiner* — Jesse Prager

(57) ABSTRACT

An aspect of the invention is a turbine blade for a gas turbine, comprising a blade root, adjoining which one after the other are a platform region having a transversely running platform and then a blade profile curved in the longitudinal direction, comprising at least one cavity which is open on the root side and through which a coolant can flow and which extends through the blade root and the platform region into the blade profile. The cavity is surrounded by an inner wall, on the surface of which structural elements influencing the coolant are provided. In order to prolong the service life of such a turbine blade, the invention proposes that a section, lying at least in the blade profile and adjoining the platform region, of the surface of the inner wall be free of structural elements. Such a turbine blade can preferably be used in a stationary gas turbine.

11 Claims, 3 Drawing Sheets

COOLED TURBINE BLADE FOR A GAS TURBINE AND USE OF SUCH A TURBINE BLADE

CROSS REFERENCE TO RELATED APPLICATIONS

This application is the US National Stage of International Application No. PCT/EP2006/064414, filed Jul. 19, 2006 and claims the benefit thereof. The International Application claims the benefits of European application No. 05016328.6 filed Jul. 27, 2005, both of the applications are incorporated by reference herein in their entirety.

FIELD OF INVENTION

The invention relates to a turbine blade for a gas turbine, with a blade root, to which a platform region, with a transversely extending platform, and upon it a blade airfoil, which is curved in the longitudinal direction, are connected in succession, with at least one cavity which is open on the root side, is exposable to throughflow by a cooling medium, and extends through the blade root and the platform region into the blade airfoil. Furthermore, the invention relates to the use of such a turbine blade.

BACKGROUND OF THE INVENTION

A cooled rotor blade of a gas turbine, which inside has cooling passages which extend in meander-form, is known from EP 1 469 163 A2. Turbulators, which stimulate the heat transfer from blade material to the cooling medium which flows through the cavity, are provided on the inner walls which delimit the cavities, in the region of the blade airfoil. As a result of the increased heat transfer, the turbine blade can consequently withstand higher operating temperatures.

In this case, it is disadvantageous that cracks can occur in the region of the fillet-like transition from platform to the blade airfoil, which transition in English is also referred to as a fillet, and/or in the platform. If the cracks which develop exceed a critical crack length, then a safe operation of the gas turbine, which is equipped with such a turbine blade, is not ensured.

SUMMARY OF INVENTION

Therefore, an especially long service life of the turbine blade is a design objective, by which the availability duration of a gas turbine which is equipped with it can be further increased. The object of the invention is the provision of a turbine blade for a gas turbine, with which the fatigue life is extended. Moreover, it is the object of the invention to disclose the use of such a turbine blade.

The object which is focused upon the turbine blade is achieved by a generic-type turbine blade which is designed according to the features of the claims.

The invention is based on the knowledge that wear and crack development, and also the subsequent crack propagation, are thermally dependent. The material of the turbine blade is subjected to thermal stresses which arise as a result of the external impingement by hot gas and the cooling which takes place inside. It has been proved that during operation of the gas turbine, locally comparatively low temperatures on the hot gas side occur in the fillet-like transition region between blade airfoil and platform, compared with those temperatures in the region of the blade airfoil. Therefore, the internally cooled turbine blade, with turbulators which are arranged on the inner walls in the region of the platform, was previously cooled too intensely in locally defined regions. Consequently, locally comparatively large temperature differences and correspondingly large thermal stresses, which were able to cause wear, occurred in the blade material.

The invention proposes to significantly reduce these local thermal stresses in the transition region by this simply not being cooled as intensely as the blade airfoil. In order to achieve this, with a generic-type turbine blade it is provided that a section of the surface of the inner wall, which section lies at least within the blade airfoil and adjoins the platform region, is free of structural elements.

Consequently, the heat transfer from the blade material to the cooling medium which flows past is locally reduced in the region of the transition radius in order to purposefully reduce in this way the thermal gradient at this point. This reduction leads to a locally hotter transition region with regard to the prior art. Therefore, lower thermal stresses are formed in the transition radius between the platform and the blade airfoil, as a result of which at this point crack development can be reduced and crack propagation can be delayed. Wear is reduced as a result.

At the same time, the temperature drop in the blade material, on account of the hotter transition region, is lowered in the section between the edge of the platform and the cavity, which extends the service life of the turbine blade.

By means of the proposed measure, the service life, especially the fatigue life (low cycle fatigue=LCF) for the platform and its transition into the blade airfoil, i.e. in the fillet, is extended.

Advantageous developments are disclosed in the dependent claims.

The development in which the surface of the inner wall at the level of the platform region, and the surface of the inner wall of the section which adjoins it inside the blade airfoil, are flat, is especially advantageous. On account of the unswirled cooling medium flow in this section, the heat transfer from the blade material to the cooling medium, compared with the heat transfer in the blade airfoil, is reduced, so that the temperature difference between an external surface of the blade airfoil, which is impinged by hot gas, that is the hot side, and the inner wall of the turbine blade which is impinged by cooling medium, that is the cold side, can be significantly reduced by means of a permissible raising of the material temperature. The reduction leads to reduced thermal stresses, especially in the region of the transition between the blade airfoil and the platform, that is in the fillet.

Since the structural elements on the inner wall of the blade airfoil as a rule are indeed areally spaced apart, but, as viewed in the radial direction, forming a mean minimum spacing, an advantageous development provides that a distance which is defined between the platform surface and, also as viewed in the radial direction, the adjacent structural element nearest to it, is greater than the mean minimum spacing between two adjacent structural elements. In this case, the distance is preferably at least 1.1 times the mean minimum spacing.

It has been proved to be further advantageous for the section to have a height of 5% of the airfoil height of the blade airfoil up to the airfoil tip, calculated from the platform surface. The development in which a region of the inner wall, which has the structural elements and lies within the blade airfoil, starts only after a height of 10% of the airfoil height, calculated from the platform surface in the direction of the airfoil tip, is especially advantageous.

An especially advantageous reduction of the temperature difference between the hot side and the cold side, especially in the otherwise especially wear-affected transition region, can be effected by means of these measures.

In an advantageous development, the structural elements are formed as turbulators in the form of ribs, block fields, dimples and/or nipples.

Since the local temperature difference between the hot side and the cold side, which causes wear, especially in a center region of the transition region, occurs between a leading edge of the blade airfoil and a trailing edge of the blade airfoil, it is especially advantageous if the surface of the inner wall which lies in the center region between the leading edge and the trailing edge is free of structural elements. In this case, the turbine blade can have a plurality of cavities which extend through the turbine blade in the radial direction and are separated by means of support ribs, in which only the cavity which lies between the leading edge and the trailing edge of the blade airfoil in the center region has the section of the inner wall, the surface of the inner wall of which within the blade airfoil is free of structural elements.

This comes from the knowledge that along the longitudinal edge of the platform, as viewed from the leading edge to the trailing edge, a temperature variation is established in the blade material, which in the region of the leading edge and of the trailing edge has in each case a relative maximum and between them, in the center region, has a local minimum. This temperature minimum can be raised by means of the proposed measures. As a result, only the regions in which especially high temperature gradients previously occurred, i.e. temperature differences between the hot side and the cold side on account of an excessive cooling, are purposefully locally cooled less. In contrast, the cavities in the region of the leading edge and in the region of the trailing edge which extend along them can be provided as before with structural elements which reach to the platform.

The platform which is arranged on the pressure side in the center region between the leading edge and trailing edge is especially wide for structural reasons, so that the local temperature minimum in the blade material previously occurred at this point. The temperature minimum can be raised by reducing the thermal stress if especially the surface of the inner wall, which inner wall is formed by the suction-side airfoil wall of the blade airfoil, is free of structural elements. Consequently, an especially long service life extension of the expediently cast turbine blade can be brought about.

Moreover, for achieving the second-mentioned object, the use of a turbine blade as claimed in the claims in a preferably stationary gas turbine is proposed.

BRIEF DESCRIPTION OF THE DRAWINGS

The invention is explained with reference to Figures. In the drawing.

DETAILED DESCRIPTION OF INVENTION

Figure 1:
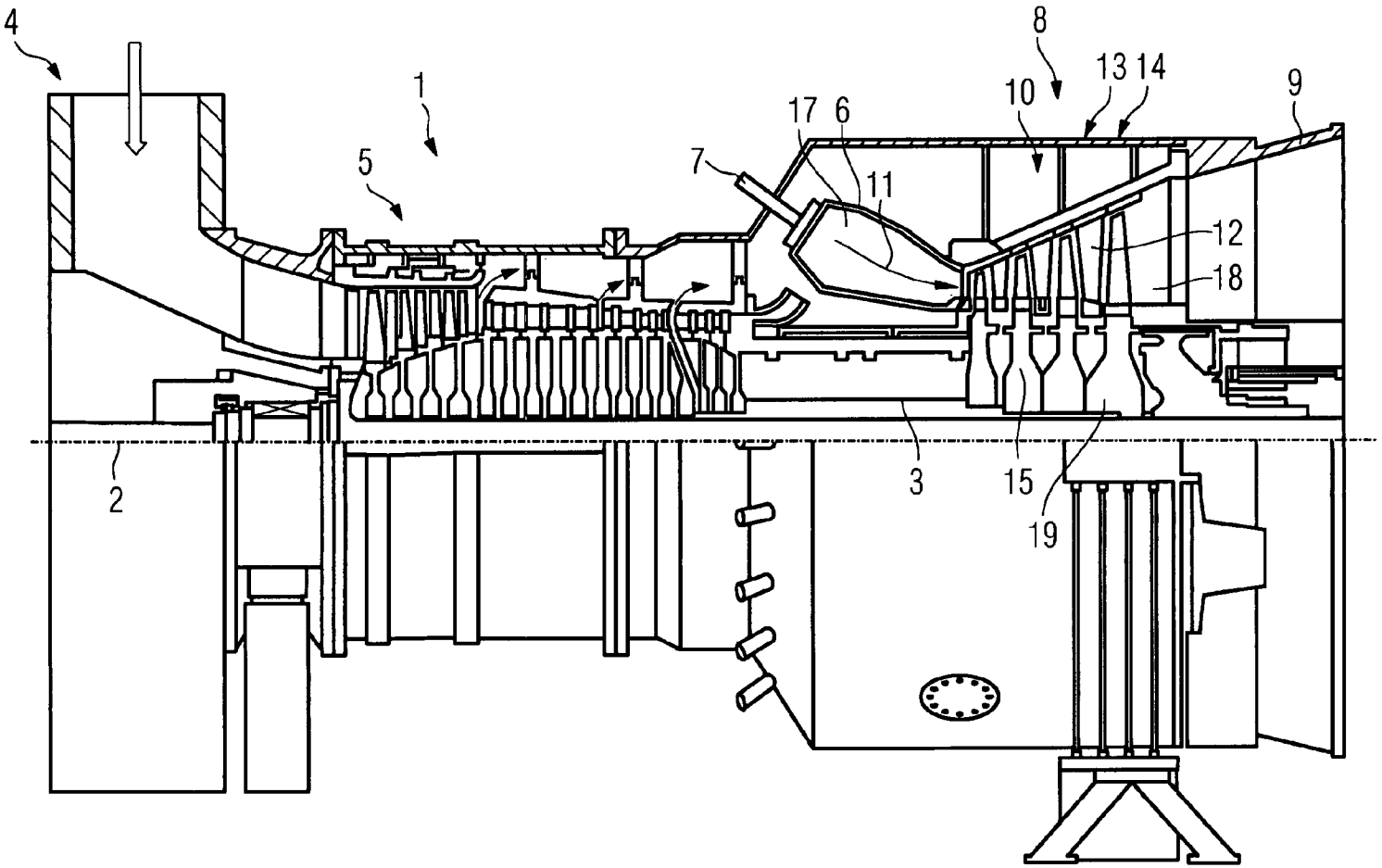
FIG. 1 shows a gas turbine in a longitudinal partial section.

FIG. 1 shows a gas turbine 1 in a longitudinal partial section. Inside, it has a rotor 3, which is also referred to as a turbine rotor, and which is rotatably mounted around a rotational axis 2. An inlet duct 4, a compressor 5, a toroidal annular combustion chamber 6 with a plurality of burners 7 which are arranged rotationally symmetrically to each other, a turbine unit 8 and an exhaust duct 9, follow in succession along the rotor 3. The annular combustion chamber 6 forms a combustion space 17 which communicates with an annular hot gas passage 18. Four turbine stages 10, which are connected one behind the other, form the turbine unit 8 there. Each turbine stage 10 is formed from two blade rings. In the hot gas passage 18, a row 14 which is formed from rotor blades 15 follows a stator blade row 13 in each case, as seen in the flow direction of a hot gas 11 which is produced in the annular combustion chamber 6. The stator blades 12 are fastened on the stator, whereas the rotor blades 15 of a row 14 are attached on the rotor 3 by means of a turbine disc 19. A generator or a driven machine (not shown) is coupled to the rotor 3.

Figure 2:
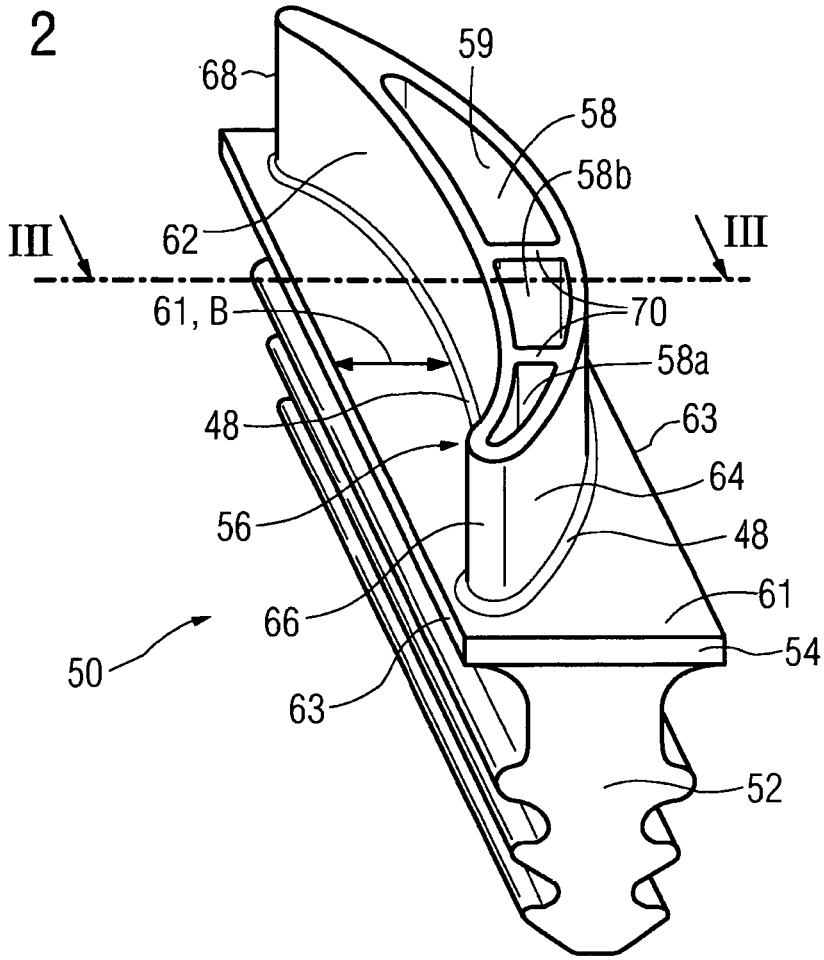
FIG. 2 shows a turbine blade in perspective view with overhanging platform regions.

FIG. 2 shows a hollow turbine blade 50 according to the invention in perspective view. The preferably cast turbine blade 50 comprises a blade root 52 upon which a platform 54, and upon it a blade airfoil 56, which is not shown in its full height but shown in a shortened form, are arranged along a blade axis.

The blade airfoil 56 has a pressure-side airfoil wall 62, and also a suction-side airfoil wall 64, which extend from a leading edge 66 of the blade airfoil 56 to a trailing edge 68.

During operation of the gas turbine 1, the hot gas 11 flows along the airfoil walls 62, 64 from the leading edge 66 in the direction of the trailing edge 68.

A fillet-like transition region 48 is formed between the platform 54 and the blade profile 56.

Three sub-cavities 58, in which a cooling medium K, which is provided for cooling, can flow in each case, extend through the turbine blade 50 from the blade root 52 into the blade airfoil 56. The first sub-cavity 58*a* extends parallel to, and in the region of, the leading edge. A second sub-cavity 58*b* follows behind it, as seen in the flow direction of the hot gas.

The sub-cavities 58 extend in the radial direction with regard to the installed position of the turbine blade 50 in the gas turbine 1, and are separated from each other by means of support ribs 70. For stiffening the blade airfoil 56, the support ribs 70 connect the pressure-side airfoil wall 62 to the suction-side airfoil wall 64.

On account of the platform longitudinal edge 63, which is rectilinear in the axial direction, of the rectilinear blade root 52 and of the blade airfoil 56 which is curved in the same direction, the platform surface 61 on the pressure side, in the region of the center sub-cavity 58, has a width B which extends transversely to the axial direction and is greater than the width of the platform surface 61 which is provided in the pressure-side region of the leading edge 66 or trailing edge 68.

For reasons of clarity, no structural elements are shown in the sub-cavities 58 of the turbine blade 50 which is shown in FIG. 2.

Figure 3:
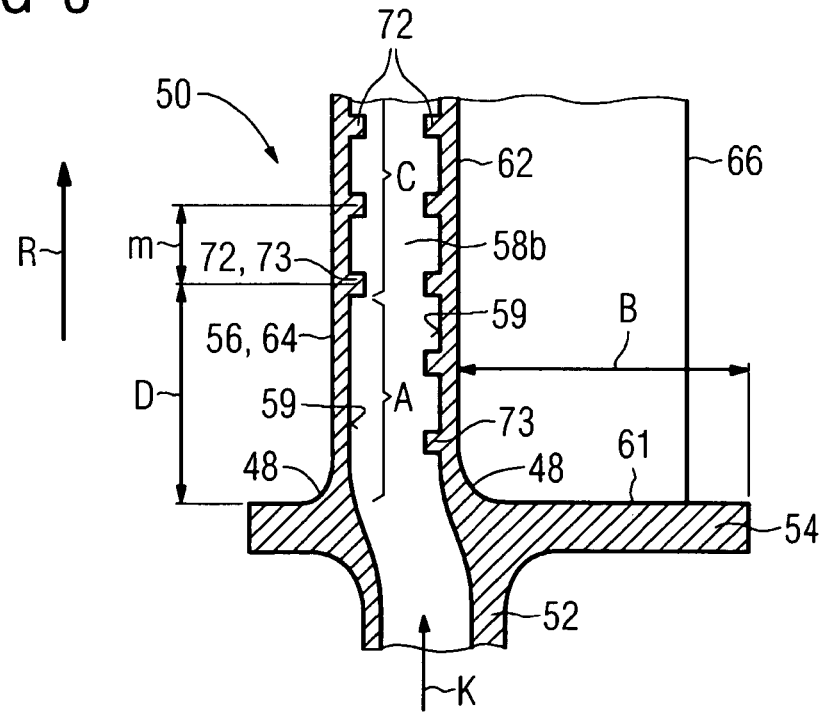
FIG. 3 shows the turbine blade according to the invention in cross section with different cooling configurations.

FIG. 3 shows the turbine blade 50 according to the invention, which is formed as a rotor blade or stator blade, in accordance with the cross section III-III of FIG. 2. The platform 54 and the blade airfoil 56 follow the blade root 52 in the radial direction, with regard to the installed position in the gas turbine 1. Both the outer side of the blade airfoil 56 and the surface 61 of the platform 54 which faces the blade airfoil 56 are subjected to the hot gas 11 which flows through the gas turbine 1, and are referred to as the hot side.

The cutting plane of the cross section III-III extends through the second of the three sub-cavities 58 which in each case are open on the root side. The cooling medium K, for example cooling air, which can be fed on the root side, cools the turbine blade 50 so that this can withstand the temperatures which occur during operation of the gas turbine.

The second sub-cavity 58*b* is enclosed by an inner wall 59 which is partially formed by the pressure-side airfoil wall 62 and by the suction-side airfoil wall 64. For increasing the heat transfer of the blade material, which is heated by the hot gas 11, to the cooling medium K which flows inside, structural elements 72 in the form of turbulators, which can be formed as ribs, block fields, dimples and/or nipples, are provided on the inner surfaces of the airfoil walls 62, 64 or of the inner walls 59. In the development which is shown, they are ribs which extend transversely to the direction of cooling medium flow.

Previously, it was customary to provide the turbulators or the structural elements 72 approximately over an entire airfoil height H from the platform 54 to the blade tip 74 (FIG. 4) on the surfaces of the inner walls 59, just like it is shown on the pressure-side airfoil wall 62 in a first section. A new method is now adopted by the invention. As shown on the inner surface of the suction-side airfoil wall 64, the structural elements 72 no longer start in the region of the platform surface 61, but start only after a predetermined height in the blade airfoil 56. As a result, a second section A of the surface of the suction-side inner wall 59, which lies within the blade airfoil 56 and adjoins the platform region, is free of structural elements 72. Although the second section A which adjoins the platform region already lies within the blade airfoil 56, the surface of the inner wall 59 which is located in this region is correspondingly flat and not profiled by structural elements.

A region C of the surface of the inner wall 59, in which turbulators or structural elements 72 have a mean minimum spacing m in relation to each other, which is defined in the radial direction, adjoins the second section A in the direction of the airfoil tip 74.

On the inner surface of the suction-side airfoil wall 64, which in the second section A which is close to the platform is free of structural elements 72, the distance D, which is measured in the radial direction, between the lowermost structural element 73, or the structural element which is adjacent to the platform surface 61, and the platform surface 61, is greater than the mean minimum spacing m. The cooling medium K, which flows in on the root side, first of all flows laminarly in the second section A on account of the locally even base surface and in the meantime convectively cools the blade material. The cooling medium K which flows in the region C is then swirled due to the structural elements 72, 73, which leads to an improved heat transfer. Consequently, it is ensured that the transition region 48 is locally cooled less than the rest of the blade airfoil 56, and in this way the thermal stresses at this point are reduced, as a result of which cracks only rarely appear. Crack propagation progresses in a delayed manner compared with a turbine blade of the prior art. Consequently, service life of the turbine blade 50 is extended by means of the proposed measures.

Figure 4:
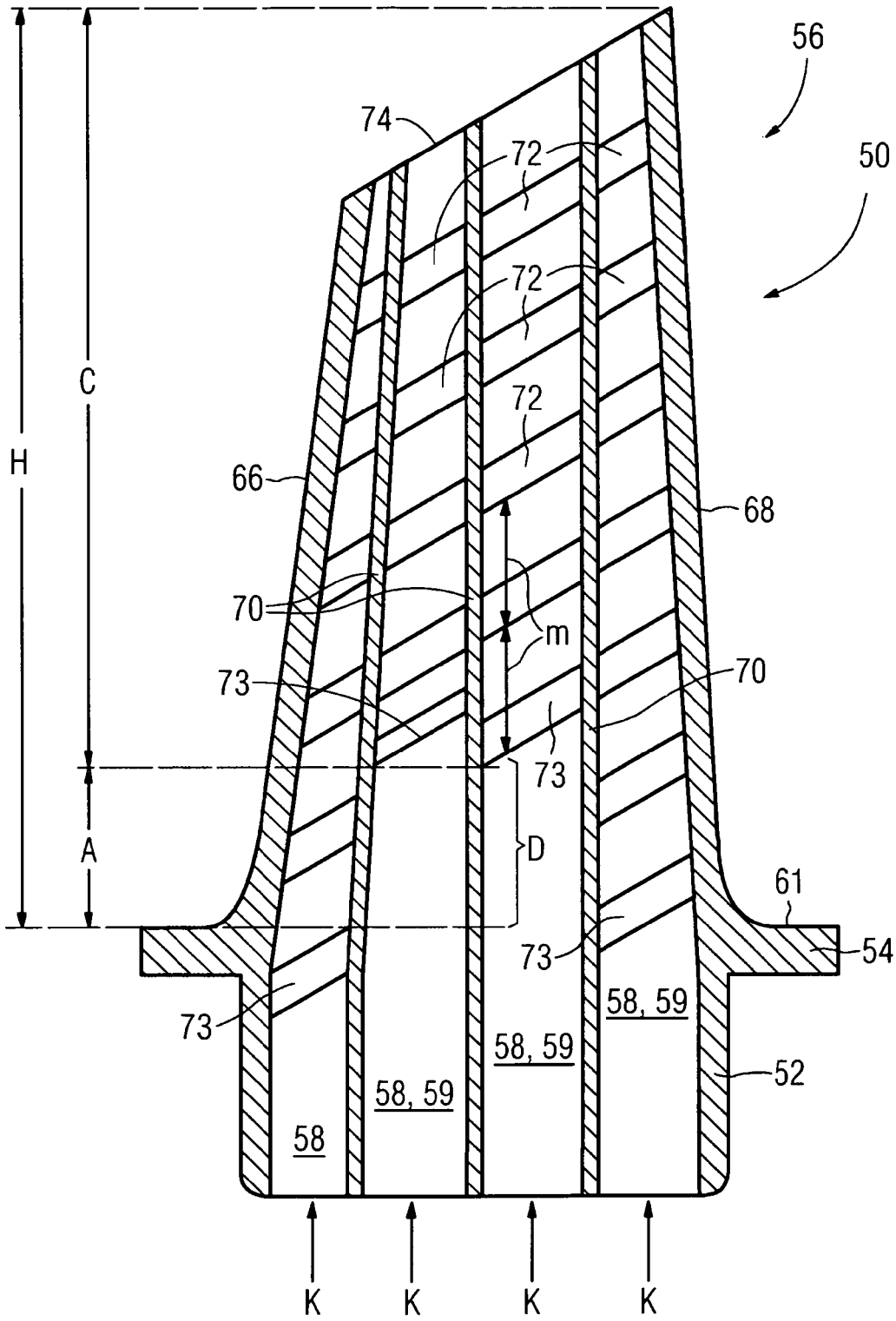
FIG. 4 shows a turbine blade according to the invention in longitudinal section with turbulators which start at different radial heights.

FIG. 4 shows a further turbine blade 50 according to the invention in longitudinal section, with a blade root 52, a platform 54 and a blade airfoil 56. The profiled blade root 52 can be formed in fir-tree form or dovetail form in cross section. The turbine blade 50 is also formed hollow and has four sub-cavities 58 which extend in the radial direction and are separated from each other by means of support ribs 70 which connect the pressure-side airfoil wall 62 to the suction-side airfoil wall 64.

During operation of the gas turbine 1, a local temperature minimum occurs in the blade material between the front region and the rear region of the transition region 48 on account of the especially wide platform 54 (see FIG. 2) at this point, which blade material is cooled less according to the invention by the structural elements 72 in the two center sub-cavities 58 not starting in the region of the platform surface 61 but starting only from a predetermined height in the blade profile 56. Therefore, the section A of the surface of the inner walls 59 which are formed by the suction-side airfoil wall 64, which section lies within the blade airfoil 56 and adjoins the platform region, is free of structural elements 72.

Although the second section A which adjoins the platform region already lies within the blade airfoil 56, the surface of the inner wall 59 which is located within this region is flat and is not profiled by structural elements. The second section A for example has a height of 5% of the airfoil height H, calculated from the platform surface 61. The section C of the inner wall, which has the structural elements 72 and lies within the blade airfoil 56, preferably starts only after a height of 10% of the airfoil height H, calculated from the platform surface 61 in the direction of an airfoil tip 74.

By the invention it is possible to less intensively cool the transition radius or transition region 48 between the blade airfoil 56 and the platform 54, and especially locally in the center region between leading edge 66 and trailing edge 68, so that the transition region is subjected to locally smaller temperature differences between the hot side, i.e. outer side of the turbine blade, and the cold side, i.e. inner side of the turbine blade. The smaller temperature differences reduce the thermal stresses in the blade material in the transition region, so that at this point crack development is reduced and crack propagation is delayed, which significantly increases the fatigue life of the turbine blade 50.

A gas turbine which is equipped with such a blade 50 can consequently be operated longer; the turbine blades 50 which are used have to be checked less frequently for defects such as cracks. As a result, the availability of the gas turbine 1 is significantly increased.

The invention claimed is:

1. A turbine blade for a gas turbine, comprising:

a blade root;

a platform region having a transversely extending platform arranged on the blade root;

a platform surface arranged on the transversely extending platform and is operatively impinged by a hot gas;

a curved blade airfoil arranged upon the platform surface and which extends through an airfoil height to a blade tip, further having a leading and a trailing edge; and a cavity contained within the blade that is open on the root side and operatively exposed to a through-flow of a cooling air wherein the cooling air has a flow direction from the root side to the blade tip in the radial direction, the cavity extending through the blade root and the platform region into the blade airfoil, and which is divided into a first sub-cavity arranged adjacent to the leading edge, and a second sub-cavity arranged adjacent to the first sub-cavity, wherein the first and second sub-cavities are partially enclosed by inner walls having structural elements arranged on the face of the inner walls which influence the cooling air, wherein a first section of the surface of the inner wall of the first sub-cavity, which section lies within the blade airfoil and adjoins the platform region, has at least one structural element, and a second section of the surface of the inner wall of the second sub-cavity, which section lies within the blade airfoil and adjoins the platform region and extends from the platform surface to a first structural element, is free of structural elements, wherein the first and second section include a same height of at least 5% of the airfoil height calculated from the platforrn surface, and wherein in the second sub-cavity, the distance between the platform surface and the adjacent structural element which is closest to it, as seen in the radial direction, is greater than a mean minimum spacing between two directly adjacent structural elements that are provided within the blade airfoil.

2. The turbine blade as claimed in claim 1, wherein the surface of the inner wall of the second sub-cavity at the level of the platform region, and the surface of the inner wall of the second section which adjoins it within the blade airfoil, are flat.

3. The turbine blade as claimed in claim 1, wherein the distance is at least 1.1 times the mean minimum spacing between two structural elements which are provided within the blade airfoil.

4. The turbine blade as claimed in claim 1, wherein a region of the inner wall having the structural elements which lies within the blade airfoil, of the second sub-cavity, starts only from a height of 10% of the airfoil height, calculated from the platfomi surface in the direction of the blade tip.

5. The turbine blade as claimed in claim 1, wherein the structural elements are formed as turbulators in the form selected from the group consisting of ribs, block fields, dimples, and nipples.

6. The turbine blade as claimed in claim 1, wherein the sub-cavities are separated from each other by means of support ribs and in which the second sub-cavity lies in the center region between the leading edge and the trailing edge of the blade airfoil.

7. The turbine blade as claimed in claim 6, wherein the blade airfoil has a suction-side airfoil wall which partially delimits the cavity, and on the inner side of which, that faces the cavity, lies the second section of the surface of the inner walls.

8. The turbine blade as claimed in claim 7, wherein the blade airfoil has a pressure-side airfoil wall which partially delimits the cavity, and on the inner side of which, which faces the cavity, lies the first section of the surface of the inner walls.

9. A gas turbine engine, comprising:

a rotor arranged along a rotational axis of the engine;

a compressor arranged coaxially around the rotor;

a combustion chamber arranged downstream of the compressor and coaxially surrounding the rotor; and a turbine arranged downstream of the combustion chamber that receives a hot gas from the combustion chamber and expands the hot gas to extract mechanical energy, wherein the turbine has a plurality of turbine blades, where each blade comprises:

a blade root;

a platform region having a transversely extending platform arranged on the blade root;

a platform surface arranged on the transversely extending platform and is operatively impinged by a hot gas;

a curved blade airfoil arranged upon the platform surface and which extends through an airfoil height to a blade tip, further having a leading and a trailing edge; and a cavity contained within the blade that is open on the root side and operatively exposed to a through-flow of a cooling air wherein the cooling air has a flow direction from the root side to the blade tip in the radial direction, the cavity extending through the blade root and the platform region into the blade airfoil, and which is divided into a first sub-cavity arranged adjacent to the leading edge, and a second sub-cavity arranged adjacent to the first sub-cavity, wherein the first and second sub-cavities are partially enclosed by inner walls having structural elements arranged on the face of the inner walls which influence the cooling air, wherein a first section of the surface of the inner wall of the first sub-cavity, which section lies within the blade airfoil and adjoins the platform region, has at least one structural element, and a second section of the surface of the inner wall of the second sub-cavity, which section lies within the blade airfoil and adjoins the platform region and extends from the platform surface to a first structural element, is free of structural elements, wherein the first and second section include a same height of at least 5% of the airfoil height calculated from the platform surface. and wherein in the second sub-cavity the distance between platform surface and the adjacent structural element which is closest to it, as seen in the radial direction, is greater than a mean minimum spacing between two directly adjacent structural elements that are provided within the blade airfoil.

10. The gas turbine engine as claimed in claim 9, wherein the surface of the inner wall of the second sub-cavity at the level of the platforms region, and the surface of the inner wall of the second section which adjoins it within the blade airfoil, are flat.

11. The gas turbine engine as claimed in claim 9, wherein the distance is at least 1.1 times the mean minimum spacing between two structural elements which are provided within the blade airfoil.

* * * * *